US008968638B2

(12) United States Patent
Tokunaga

(10) Patent No.: US 8,968,638 B2
(45) Date of Patent: Mar. 3, 2015

(54) APPARATUS FOR INJECTING SLURRY AND METHOD THEREFOR

(75) Inventor: Takeshi Tokunaga, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 337 days.

(21) Appl. No.: 12/575,000

(22) Filed: Oct. 7, 2009

(65) Prior Publication Data

US 2010/0109198 A1 May 6, 2010

(30) Foreign Application Priority Data

Oct. 31, 2008 (JP) ..... 2008-281337

(51) Int. Cl.
*B28B 13/00* (2006.01)
*B28B 11/00* (2006.01)

(52) U.S. Cl.
CPC ..... *B28B 11/006* (2013.01)
USPC ..... 264/630; 425/110

(58) Field of Classification Search
USPC ..... 264/630, 631, 177.12
See application file for complete search history.

(56) References Cited

U.S. PATENT DOCUMENTS

| | | | | |
|---|---|---|---|---|
| 3,431,889 | A | 3/1969 | Fraatz | |
| 4,411,856 | A * | 10/1983 | Montierth | 264/267 |
| 4,559,193 | A * | 12/1985 | Ogawa et al. | 264/631 |
| 5,172,862 | A | 12/1992 | Heimann et al. | |
| 6,641,057 | B2 * | 11/2003 | Thomas et al. | 239/104 |
| 6,659,372 | B2 * | 12/2003 | Marsh et al. | 239/560 |
| 7,803,303 | B2 * | 9/2010 | Hagg | 264/267 |
| 7,922,951 | B2 * | 4/2011 | Mudd et al. | 264/259 |
| 2005/0170093 | A1 | 8/2005 | Chung et al. | |
| 2005/0172891 | A1 | 8/2005 | Suzuki et al. | |
| 2007/0212483 | A1 | 9/2007 | Miyashita et al. | |
| 2007/0234694 | A1 | 10/2007 | Miyairi et al. | |

FOREIGN PATENT DOCUMENTS

| | | |
|---|---|---|
| EP | 0 435 031 A2 | 7/1991 |
| JP | U-06-085066 | 12/1994 |
| JP | A-2001-300922 | 10/2001 |
| JP | A-2003-230860 | 8/2003 |
| JP | A-2003-311944 | 11/2003 |
| JP | A-2007-269007 | 10/2007 |
| JP | A-2007-296512 | 11/2007 |

OTHER PUBLICATIONS

European Search Report issued in Application No. EP 09 252 368.7; dated Nov. 29, 2010.
Office Action issued in Japanese Patent Application No. 2008-281337 dated Jun. 14, 2011 (with translation).
May 19, 2014 Examination Report issued in European Application No. 09 252 368.7.
Feb. 28, 2014 Office Action issued in Chinese Patent Application No. 2009102076447 (with translation).

* cited by examiner

*Primary Examiner* — Yogendra Gupta
*Assistant Examiner* — Erin Snelting
(74) *Attorney, Agent, or Firm* — Oliff PLC

(57) ABSTRACT

The apparatus for injecting slurry contains the first member having the cavity therein; and the second member having a plurality of convex sections, each of the convex sections having the injection hole formed therein communicating with the cavity, wherein the protrusion length of the convex section is in a range from 3 to 5 mm, and the distance between centers of adjacent convex sections is in a range from 3 to 13 mm.

11 Claims, 6 Drawing Sheets

APPARATUS FOR INJECTING SLURRY AND METHOD THEREFOR

BACKGROUND OF THE INVENTION

1. Field of the Invention

The present invention relates to an apparatus for injecting slurry and a method therefor, specifically to the apparatus for injecting slurry capable of suppressing the generation of remained slurry in the injection hole, and to the method for injecting slurry capable of decreasing the amount of the remained slurry and forming the surface of injected slurry in various shapes with high accuracy.

2. Description of the Related Art

Honeycomb filters made of ceramic are used to collect dust and other particulate matter contained in exhaust gas generated from automobile and in incineration flue gas generated during incineration of waste. In particular, a diesel particulate filter (hereinafter referred to from time to time as "DPF") is used to remove efficiently the particulate matter (hereinafter referred to from time to time as "PM") such as soot discharged from internal combustion engines.

To increase the collection effect of particulate matter, DPF is normally provided with plugging at one end face and at the other end face of a cell so as to provide a complementary checkered-flag pattern thereon (for example, refer to Japanese Patent Laid-Open No. 2007-296512). That type of plugging is prepared by sticking an adhesive sheet or the like to one end face of the DPF before firing, by applying a mask while opening a hole on the adhesive sheet or the like only at a portion corresponding to the cells to be plugged by laser machining utilizing image processing, or the like, then by immersing the end face in a slurry via the mask, followed by firing the DPF, (for example, refer to Japanese Patent Laid-Open No. 2001-300922).

The depth of slurry being introduced in the cell to be plugged is preferably uniform because the uniform depth allows suppressing the generation of local shrinkage on firing the DPF, thus enabling the DFP to suppress deterioration. To introduce the slurry to cells to be plugged at a uniform depth, it is preferable for the surface of the slurry used for immersion to be formed in a planar state at a certain height.

The surface of the slurry used for immersion, however, was formed in a planar state using a wheel in the related art so that differences in the surface height appeared depending on the skill of the workers. To this point, there has been developed an apparatus for injecting slurry that can form a uniform height of the surface of slurry in a planar state without using wheel.

FIG. 3 is a schematic drawing illustrating an example of the slurry-injected state of an apparatus for injecting slurry in the related art. As shown in FIG. 3, use of an apparatus for injecting slurry 20 very often generated a remained slurry 21 in ejection holes 5. Once that kind of remained slurry 21 is generated, there raises a problem of affecting the physical properties of slurry to deteriorate the DPF on applying the apparatus for injecting slurry in the next operation. Furthermore, since the DPF often gives a difference in pressure loss between the central part and the outer peripheral part thereof, there is a need of manufacturing the DPF having plugging being formed so that the depth of the slurry introduced in the cells may differ between the depth thereof at the central part and the depth thereof at the outer peripheral part. The apparatus for injecting slurry 20 according to the related art, however, was not able to respond to those problems.

SUMMARY OF THE INVENTION

The present invention has been perfected to solve these problems of the related art, and an issue of the present invention is to provide an apparatus for injecting slurry capable of suppressing the generation of remained slurry in the injection hole. Another issue of the present invention is to provide a method for injecting slurry capable of decreasing the amount of the remained slurry and forming the surface of injected slurry in various shapes with high accuracy.

The inventors of the present invention conducted detail studies to solve the above issues, found that the above issues can be solved by providing the second member with convex sections, each of which has an injection hole formed therein and has a specified length thereof and a specified spacing therebetween, and thus perfected the present invention. Furthermore, the inventors of the present invention found that the above issues can be solved by using the apparatus for injecting slurry according to the present invention, and by injecting slurry at a specified distance between the flat plane and the protruded end of the convex section, thereby perfected the present invention.

That is, the present invention provides an apparatus for injecting slurry and a method for injecting slurry, described below.

[1] An apparatus for injecting slurry, comprising: a first member having a cavity therein; and a second member having a plurality of convex sections, each of the convex sections having an injection hole formed therein communicating with the cavity, wherein the protrusion length of the convex section is in a range from 3 to 5 mm, and the distance between centers of adjacent convex sections is in a range from 3 to 13 mm.

[2] The apparatus for injecting slurry according to [1], wherein the diameter of the injection hole formed inside of the convex section at outer peripheral part of the second member and the diameter of the injection hole formed inside of the convex section at central part of the second member are not the same with each other.

[3] The apparatus for injecting slurry according to [1] or [2], wherein the diameter of the injection hole formed inside of the convex section at outer peripheral part of the second member is larger than the diameter of the injection hole formed inside of the convex section at central part of the second member.

[4] The apparatus for injecting slurry according to [1] or [2], wherein the diameter of the injection hole successively widens or narrows from the central part toward the outer peripheral part of the second member.

[5] The apparatus for injecting slurry according to any of [1] to [4], wherein the length of the second member in the injection direction at the outer peripheral part thereof and the length of the second member in the injection direction at the central part thereof are not the same with each other.

[6] The apparatus for injecting slurry according to any of [1] to [5], wherein the length of the second member in the injection direction at the outer peripheral part thereof is shorter than the length of the second member in the injection direction at the central part thereof.

[7] The apparatus for injecting slurry according to any of [1] to [5], wherein the length of the second member in the injection direction successively elongates or shortens from the central part toward the outer peripheral part of the second member.

[8] A method for injecting slurry, comprising: a filling step which comprises filling a slurry in the cavity of the apparatus for injecting slurry according to any of [1] to [7]; and, an injection step which comprises above a flat plane in a container, causing a protruded end of the convex section to face the flat plane with the flat plane and the protruded end of the convex section spaced apart from each other by a distance of 3 to 10 mm, and injecting the slurry onto the flat plane.

[9] The method for injecting slurry according to [8], wherein the injection step is the step of holding the slurry injected onto the flat plane at a height ranging from 1 to 10 mm thereon.

[10] The method for injecting slurry according to [8] or [9], wherein the viscosity of the slurry is in a range from 10 to 1000 dP·s.

EFFECT OF THE INVENTION

The apparatus for injecting slurry according to the present invention provides an effect of capable of suppressing the generation of remained slurry in the injection hole.

In addition, the method for injecting slurry according to the present invention provides an effect of capable of decreasing the amount of the remained slurry and forming the surface of injected slurry in various shapes with high accuracy.

DESCRIPTION OF REFERENCE NUMERALS

1, 31, 41, 51, 61, 71, 81: Apparatus for injecting slurry, 2: First member, 3, 33, 43, 53, 63, 73, 83: Second member, 4: Cavity, 5, 55, 65, 75, 85: Injection hole, 6, 56, 66, 76, 86: Convex section, 35, 45: Injection hole at the outer peripheral part of the second member, 36, 46: Convex section at the outer peripheral part of the second member, 37, 47: Injection hole at the central part of the second member, 38, 48: Convex section at the central part of the second member, 7: Introduction opening, d: Protrusion length, l: Distance between centers, f: Length in the injection direction, 10: Container, 11: Flat plane, 12: Protruded end, 13: Slurry, W: Distance between the flat plane and the protruded end of the convex section, T: Height of the slurry, 20: Apparatus for injecting slurry, 21: Remained slurry

DESCRIPTION OF THE PREFERRED EMBODIMENT

The preferred embodiments for carrying out the present invention are described below. However, the present invention is not restricted to the following embodiments and it should be construed that there are also included, in the present invention, those embodiments in which appropriate changes, improvements, etc. have been made to the following embodiments based on the ordinary knowledge possessed by those skilled in the art, as long as there is no deviation from the gist of the present invention.

1. Apparatus for Injecting Slurry

Figure 1:
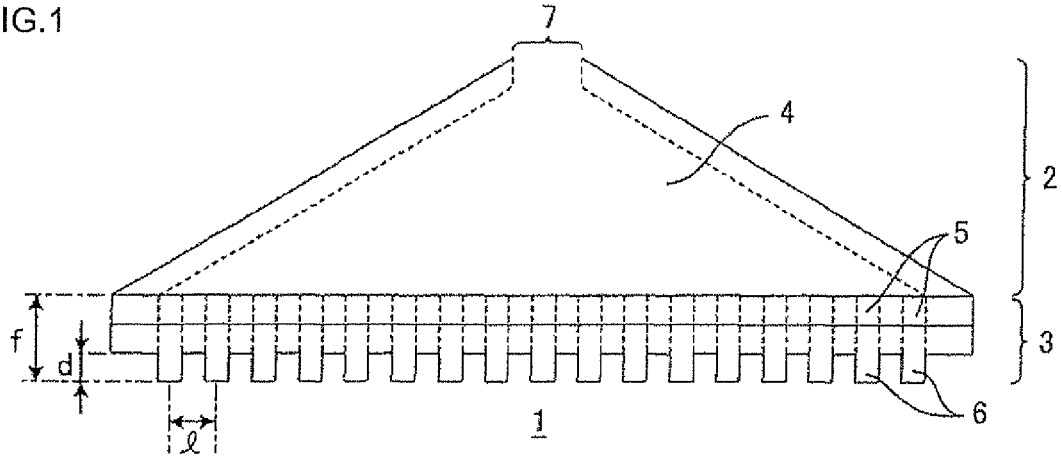
FIG. 1 is a schematic drawing illustrating an embodiment of an apparatus for injecting slurry of the present invention.

FIG. 1 is a schematic drawing illustrating an embodiment of the apparatus for injecting slurry of the present invention. As illustrated in FIG. 1, an apparatus for injecting slurry 1 in the embodiment has, a first member 2 having a cavity 4 therein, and a second member 3 having a plurality of convex sections 6, each of the convex sections having an injection hole 5 formed therein communicating with the cavity 4. When the apparatus for injecting slurry 1 illustrated in FIG. 1 is used, after the slurry is filled in the cavity 4 entering from an introduction opening 7 of the first member 2, the slurry flows from the cavity 4 into the injection holes 5 of the second member 3 uniformly, and then the slurry is injected from each convex section 6.

Figure 2:
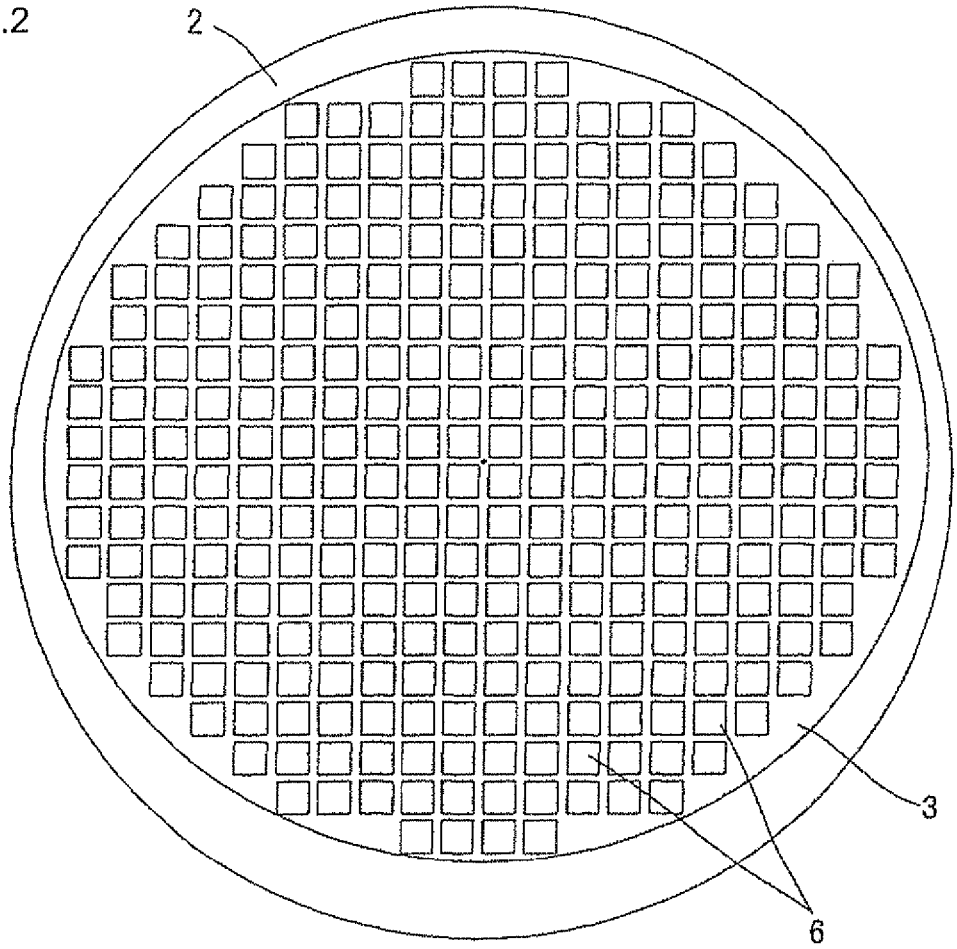
FIG. 2 is a bottom view illustrating an embodiment of the apparatus for injecting slurry of the present invention.

FIG. 2 is a bottom view illustrating an embodiment of the apparatus for injecting slurry of the present invention. As illustrated in FIG. 2, the apparatus 1 for injecting slurry of the embodiment has: the first member 2; and the second member 3 having a plurality of convex sections 6, each of the convex sections having an injection hole therein. In FIG. 2, the shape of the second member 3 is in a circular shape. In the apparatus for injecting slurry of the present invention, however, the shape of the second member is not specifically limited, and adequate shape design is applicable depending on the use object. For example, when the injected slurry is used to plug a DPF, the shape of the second member is preferably designed to agree with the outer shape of the DPF. More specifically the shape design may be in circular shape, elliptical shape, quadrangular shape, and the like.

1.1 First Member

The first member 2 is the one having the cavity 4 therein. The size of the cavity 4 is arbitrary if only the size allows the filling slurry to flow uniformly into the injection holes 5 of the second member 3. In FIG. 1, the introduction opening 7 to fill the cavity 4 with the slurry is formed at upper part of the first member 2. The apparatus for injecting slurry of the present invention, however, is not limited to that position, and arbitrary position is acceptable if only the slurry can uniformly flow into the injection holes 5 of the second member 3.

1.2 Second Member

The second member 3 has a plurality of convex sections 6, each of the convex sections having an injection hole 5 therein communicating with the cavity 4, wherein the protrusion length d of the convex section 6 and the distance l between centers of adjacent convex sections 6 are at a specified value, respectively. With those convex sections 6, generation of the remained slurry in the injection hole 5 during the injection of slurry from the injection hole 5 can be suppressed.

The protrusion length d of the convex section 6 is in a range from 3 to 5 mm, preferably 3.5 mm or more and below 5 mm, and more preferably 4 mm or more and below 5 mm. If the protrusion length d is outside the above range, the amount of remained slurry in the apparatus for injecting slurry 1 may increase. In FIG. 1, the protrusion length d of the convex section 6 is the same for all the convex sections. The apparatus for injecting slurry of the present invention, however, is not limited to the uniform protrusion length d, and the injection length at the outer peripheral part of the second member 3 and the injection length at the central part of the second member 3 may not be the same with each other. For example, there may be applied to shorten or elongate from the central part toward the outer peripheral part at an equal interval. The term "outer peripheral part of the second member" referred to herein signifies the region from the outermost periphery of the injected slurry to a position of 5 mm inward therefrom. The term "central part of the second member" referred to herein signifies the region from the center to a position of 50 mm in radius therefrom.

The distance l between centers of adjacent convex sections 6 is in a range from 3 to 13 mm, preferably from 4 to 12 mm, and more preferably from 6 to 10 mm. If the distance l between centers is outside the above range, there may occur the case of increase in the amount of slurry remained in the apparatus for injecting slurry 1, and the case of failing in forming accurately the surface of slurry in various shapes. Although it is preferable for the distance l between centers to be uniform over the whole area of bottom of the second member 3, it is possible to arbitrarily select the distance by, for example, shortening thereof at the central part or shortening thereof at the outer peripheral part, responding to the use object. When the distance l between centers is not brought to uniform, it is necessary that 30% or more of all of the injection holes 5 are within the above range, preferably 50% or more thereof are within the above range, and most preferably all of the injection holes are within the above range.

If the distance between centers is within the above range, the distance between centers at the outer peripheral part of the second member and the distance between centers at the central part of the second member may not be the same with each other, and more preferably the distance between centers at the outer peripheral part of the second member is larger than the distance between centers at the central part of the second member. The selection of arbitrary distance between centers allows forming the surface of the injected slurry suitably and accurately.

Figure 4A:
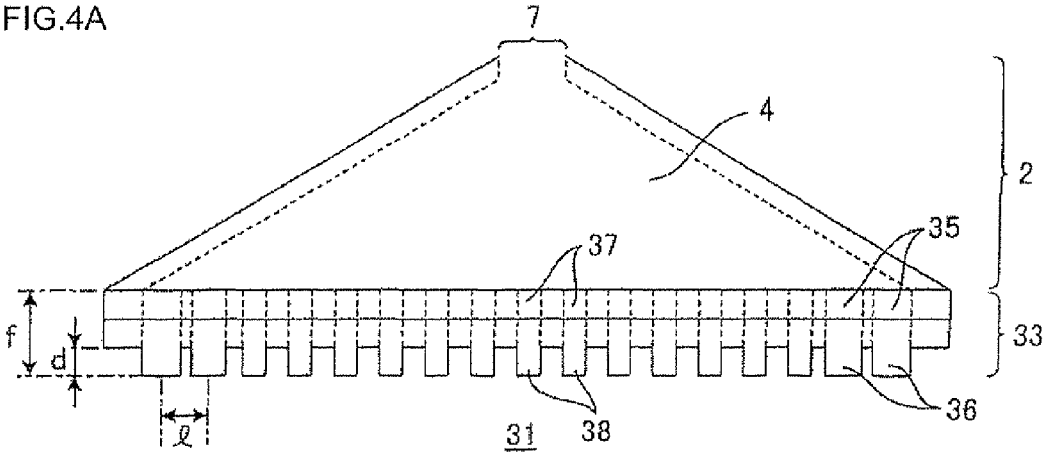
FIG. 4A is a schematic drawing illustrating another embodiment of the apparatus for injecting slurry of the present invention.
Figure 4B:
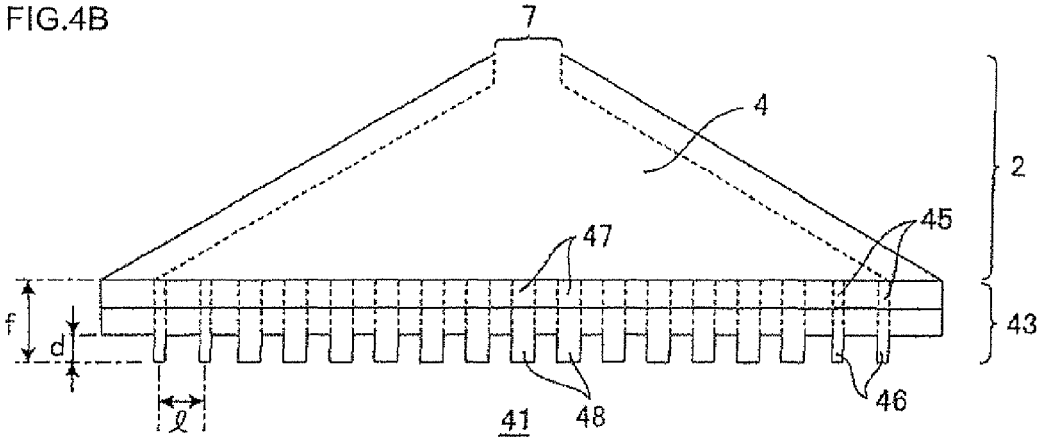
FIG. 4B is a schematic drawing illustrating further embodiment of the apparatus for injecting slurry of the present invention.

FIG. 1 shows an example in which the diameter of injection hole 5 is uniform over the range from the central part toward the outer peripheral part of the second member 3. The apparatus for injecting slurry of the present invention is not limited to the uniform hole diameter, and there may be the case that the diameter of the injection hole formed inside of the convex section at the outer peripheral part of the second member and the diameter of the injection hole formed inside of the convex section at the central part of the second member are not the same with each other. More specifically, there are examples as illustrated in FIG. 4A, the diameter of the injection hole 35 formed inside of the convex section 36 at outer peripheral part of the second member 33 is larger than the diameter of the injection hole 37 formed inside of the convex section 38 at the central part of the second member 33; and as illustrated in FIG. 4B, the diameter of the injection hole 45 formed inside of the convex section 46 at outer peripheral part of the second member 43 is smaller than the diameter of the injection hole 47 formed inside of the convex section 48 at the central part of the second member. By varying the diameter of injection hole as described above, the large hole diameter part enables the slurry to inject in large amount, while the small hole diameter part enables the slurry to inject in smaller amount. Consequently, for example, when the injected slurry is used for plugging a DPF, larger amount of slurry is injected at the central part where the flue gas flow rate is large to make the plug stiff, as an application example in use. As an application example in manufacturing, when the injection pressure at the outer peripheral part is likely difficult to apply caused by the shape of the first member 2, the outer peripheral part may adopt a relatively large hole diameter to attain balance with the central part.

Figure 6A:
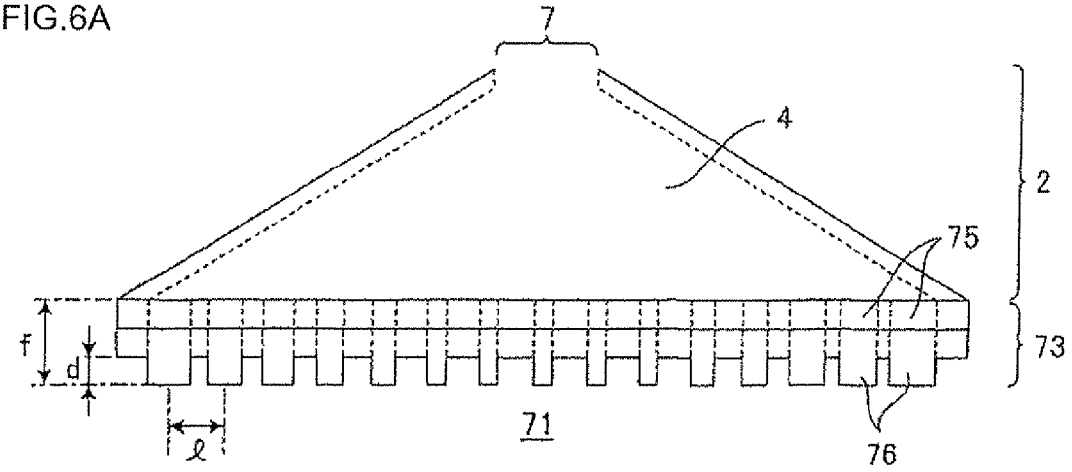
FIG. 6A is a schematic drawing illustrating more another embodiment of the apparatus for injecting slurry of the present invention.
Figure 6B:
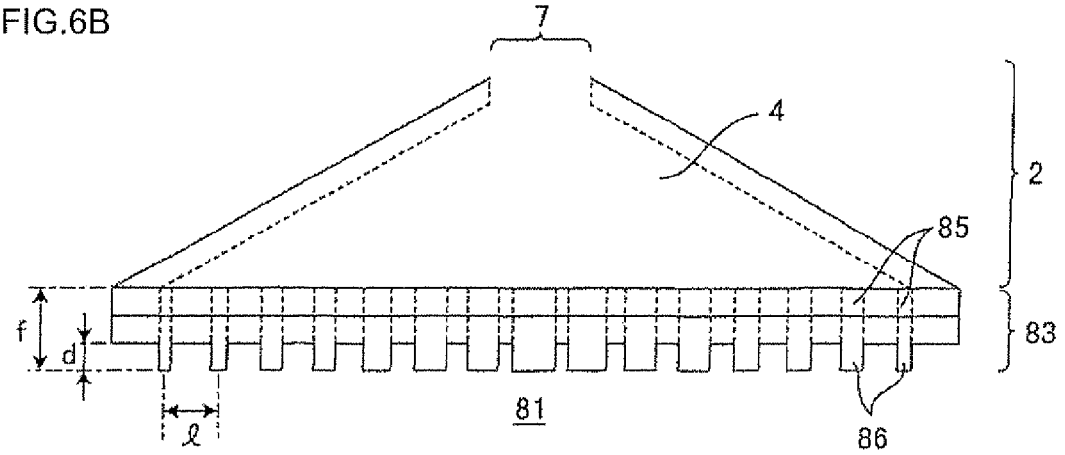
FIG. 6B is a schematic drawing illustrating more another embodiment of the apparatus for injecting slurry of the present invention.

As illustrated in FIG. 6A, the diameter of the injection hole 75 may be successively widened from the central part toward the outer peripheral part of the second member 73. Alternatively, as illustrated in FIG. 6B, the diameter of the injection hole 85 may be successively narrowed from the central part toward the outer peripheral part of the second member 83. By successively widening or narrowing the diameter of the injection hole from the central part toward the outer peripheral part of the second member, the surface of the slurry is not formed in a planar state, but for example, the surface thereof can be formed in various shapes, for example, convex shape or concave shape, with high accuracy.

The shape of the injection hole is not specifically limited, and for example the shape thereof includes circular, quadrangular, or triangular shape. For example, use of a polygonal shape injection hole having equivalent wet side-length with that of the circular shape attains similar quality with that attained by injection through circular injection hole. The arrangement of the injection holes, (or the arrangement of the convex sections), is not specifically limited either, and arbitrarily selected arrangement is applicable, including random arrangement, radial arrangement, and grid arrangement. Among these arrangements, grid arrangement is preferred from the standpoint such that the distance between injection holes (or the distance l between centers) is easily controlled.

Figure 5A:
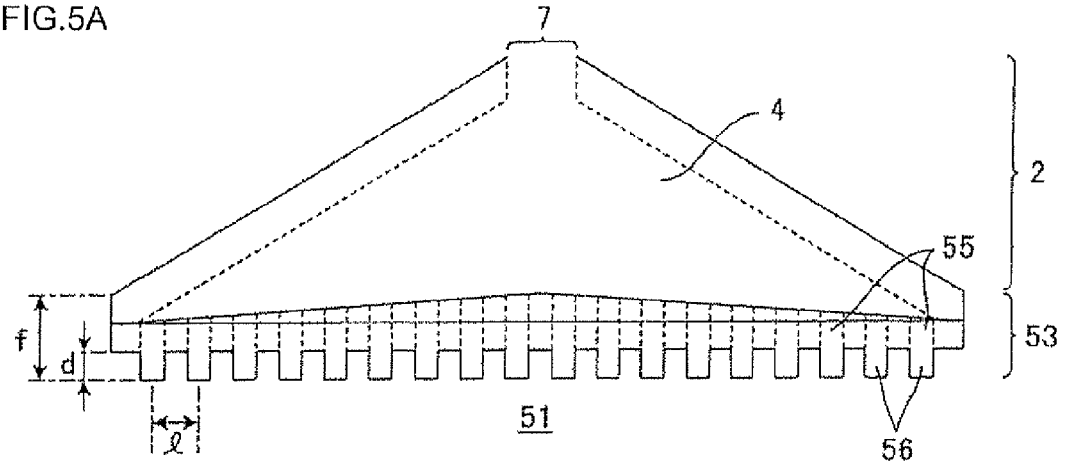
FIG. 5A is a schematic drawing illustrating still another embodiment of the apparatus for injecting slurry of the present invention.
Figure 5B:
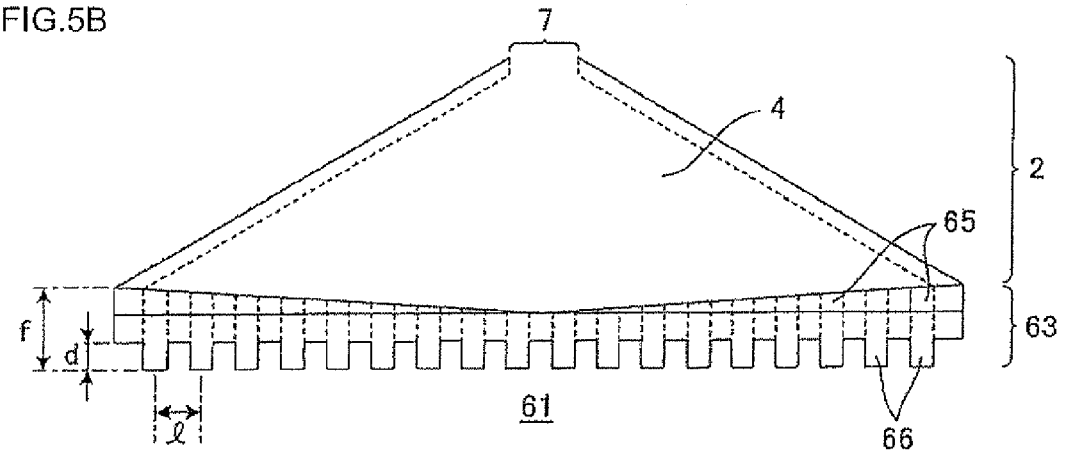
FIG. 5B is a schematic drawing illustrating still further embodiment of the apparatus for injecting slurry of the present invention.

FIG. 1 gives an example that the length f of the second member 3 in the injection direction is uniform from the central part toward the outer peripheral part of the second member 3. The apparatus for injecting slurry of the present invention, however, is not limited to the example, and there may be the case that, as illustrated in FIG. 5A and FIG. 5B, the length of the second member in the injection direction at the outer peripheral part and the length of the second member in the injection direction at the central part may not be the same with each other. More specifically there may be the case that, as illustrated in FIG. 5A, the length f of the second member 53 in the injection direction is successively shortened from the central part toward the outer peripheral part of the second member 53, or the case that, as illustrated in FIG. 5B, the length f is successively elongated from the central part toward the outer peripheral part of the second member 63. By making the length f in the injection direction non-uniform, the flow pass resistances become different among the flow passages, and the shorter portion allows slurry to inject in larger amount, while the longer portion allows slurry to inject in smaller amount. Consequently, when, for example, the injected slurry is used to plug a DPF, larger amount of slurry is injected at the central part where the flue gas flow rate is large to make the plug stiff, as an application example in use. As an application example in manufacturing, when the injection pressure at the outer peripheral part is likely difficult to apply caused by the shape of the first member 2, the length f at the outer peripheral part in the injection direction is brought to relatively short, thus to attain balance with the central part. Furthermore, by successively elongating or shortening the length f of the second member in the injection direction from the central part toward the outer peripheral part of the second member, the surface of the slurry is not formed in a planar state, but for example, the surface thereof can be formed in various shapes, for example convex shape or concave shape, with high accuracy. When, the slurry is injected using the apparatus for injecting slurry 51 as illustrated in FIG. 5A, the pressure loss can be controlled, and the remaining of slurry inside the injection hole at the outer peripheral part can further be suppressed.

2. Method for Injecting Slurry

The method for injecting slurry according to the present invention has the filling step which contains filling the slurry in the cavity of the apparatus for injecting slurry described in "1. Apparatus for injecting slurry", and the step which contains causing a protruded end of the convex section to face the flat plane with the flat plane and the protruded end of the convex section spaced apart from each other by a distance of 3 to 10 mm, and injecting the slurry onto the flat plane. By injecting slurry in the above procedure, the amount of slurry remained in the apparatus for injecting slurry can be decreased, and the surface of the injected slurry can be formed in various shapes with high accuracy.

Figure 7:
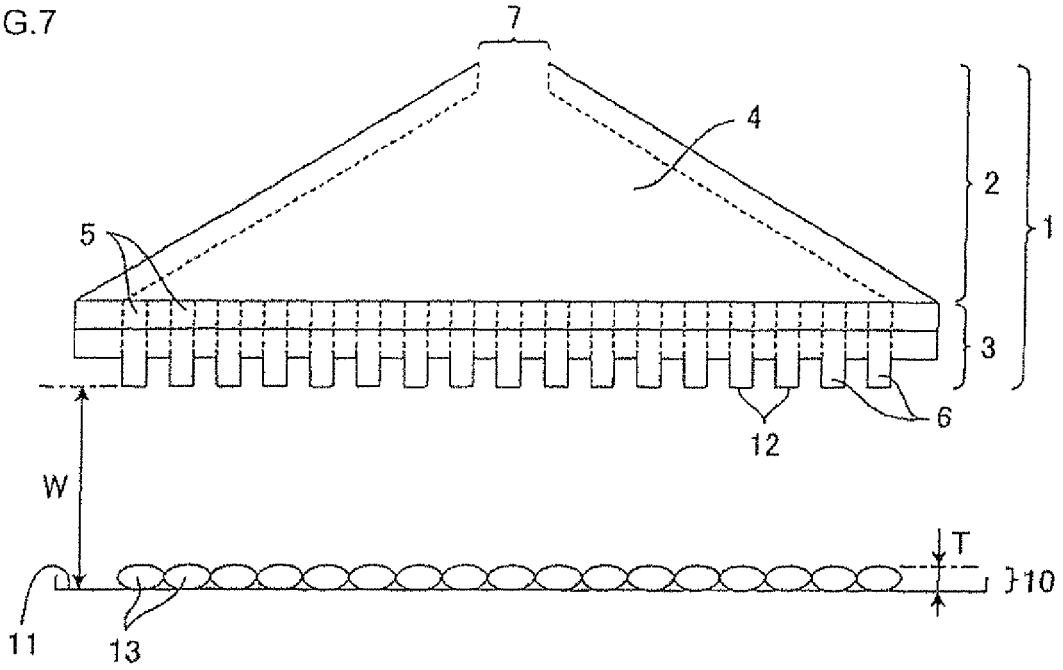
FIG. 7 is a schematic drawing illustrating an example of slurry-injected state in an embodiment using the method for injecting slurry of the present invention.

FIG. 7 is a schematic drawing illustrating an example of slurry-injected state in an embodiment using the method for injecting slurry of the present invention. In FIG. 7, the apparatus for injecting slurry uses the apparatus for injecting slurry 1 given in FIG. 1. The apparatus for injecting slurry used in the method for injecting slurry according to the present invention, however, is not limited to the one given above, and for example, there may be applied the apparatus for injecting slurry 31, 41, 51, 61, 71, or 81, illustrated in FIGS. 4 to 6, respectively. The following-description is given with the use of the apparatus for injecting slurry 1 illustrated in FIG. 1.

As illustrated in FIG. 7, the apparatus for injecting slurry 1 is positioned above the container 10 having the flat plane 11 causing a protruded end of the convex section to face the flat plane 11 with the flat plane 11 and the protruded end 12 of the convex section 6 spaced apart from each other by a specified distance w. The flat plane 11 holds the slurry 13 at a specified height T. In addition, the injection hole 5 of the apparatus for injecting slurry 1 does not generate the remained slurry 21 shown in FIG. 3.

2.1 Filling Step

The filling step is the step of filling the slurry in the cavity 4 existing inside of the first member 2 of the apparatus for injecting slurry 1. The method for filling the slurry is not specifically limited, and for example, a method of filling the slurry via the introduction hole 7 is applied.

The slurry can be prepared by kneading at least a ceramic powder and a disperser for slurry. The kind of the ceramic powder is not specifically limited, and for example, a silicon carbide powder and a cordierite powder can suitably be applied. Preferable disperser for slurry includes organic solvent such as acetone, ethanol, and methanol, and water or the like.

The slurry may further contain, as needed, additives such as binder and deflocculant. The binder may be a resin such as polyvinylalcohol (PVA) and a polysaccharide such as starch. Combined use of a thermal-gel-setting binder having a characteristic of gelling under heating is more preferable. A preferable thermal-gel-setting binder is methylcellulose.

The viscosity of slurry is preferably in a range from 10 to 1000 dP·s, more preferably from 50 to 500 dP·s, and most preferably from 100 to 300 dP·s. If the viscosity is below 10 dP·s, the slurry cannot be held at a specified height T on the flat plane 11 in some cases. If the viscosity exceeds 1000 dP·s, the shape of the surface of the injected slurry cannot be formed in various shapes with high accuracy in some cases.

2.2 Injection Step

The injection step is the step of causing the apparatus for injecting slurry 1 to face the protruded end 12 of the convex section 6 spaced apart from each other by a specified distance W above the flat plane 11 of the container 10, and of injecting the slurry filled in the cavity 4 inside of the first member 2 of the apparatus for injecting slurry 1 onto the flat plane 11 via the injection hole 5. The injection step is preferably the step of holding the slurry 13 at a height T in a range from 1 to 10 mm on the flat plane 11. There is also a suitable method in which the slurry is injected while measuring the height T so as to attain the height T ranging from 1 to 10 mm on the flat plane 11. To obtain the specified height T more simply in a mass-production line, however, there may be adopted a method in which a preliminary survey is given to determine the volume of filling slurry in the filling step to attain the specified height T by injecting the filled slurry, and the control of the height T is done by the filling amount of the slurry.

The distance W between the flat plane 11 and the protruded end 12 of the convex section 6 is in a range from 3 to 10 mm, more preferably from 4 to 9 mm, and most preferably from 5 to 8 mm. If the distance W is outside the above range, the amount of slurry remained in the apparatus for injecting slurry 1 increases, or the surface shape of the injected slurry gives a dispersion in some cases.

The height T of the slurry 13 held on the flat plane 11 is preferably in a range from 1 to 10 mm, more preferably from 2 to 9 mm, and most preferably from 3 to 8 mm. If the height T is below 1 mm, the amount of slurry remained in the apparatus for injecting slurry 1 increases in some cases. If the height T exceeds 10 mm, the amount of slurry remained in the apparatus for injecting slurry 1 increases, or the shape of the surface of the injected slurry cannot be formed in various shapes with high accuracy, in some cases. The height T can be determined by a simple method such as mounting a gauge on an inside face of the container or erecting a gauge after injecting the slurry. The height of slurry is determined immediately after the slurry injection. If the injected slurry holds as-injected shape, the apex height is adopted as the slurry height. If the injected slurry does not hold as-injected shape, the maximum height in the shape immediately after the injection is adopted as the slurry height.

A preferable relation between the height T of the slurry 13 and the distance W from the slurry 13 is $T \leq W$, more preferably $T \leq 0.9$ W, and most preferably $T \leq 0.8$ W. The height T is not necessarily required to be uniform (flat) over the whole flat plane, and arbitrary selection can be applied such as widened central part (convex shape) and widened outer peripheral part (concave shape), depending on the use object. In that case, it is necessary to have a portion in which at least the height T satisfies the above range, and it is more preferable that the portion of the lowest height T satisfies the above range. The height T of both portions most preferably satisfies the above range. The height T of the slurry 13 can be controlled by the injection length, the distance between centers, a gradient in diameter of the injection holes, and the distance between the flat plane and the ejection end of the apparatus for injecting slurry.

The slurry injected using the method for injecting slurry according to the present invention is suitably used as, for example, a plugging member for plugging a honeycomb structure. Different from the conventional method, the injected slurry can form the surface of slurry in various shapes with high accuracy. Consequently, on using the honeycomb structure as DPF, arbitrary selection of filling the plugging member is applied such as shallower plugging for a cell of large pressure loss, and deeper plugging for a cell of small pressure loss.

EXAMPLES

The present invention will be described in detail in the following referring to the examples. The present invention, however, is not limited to these examples. The term "part" given in Examples and Comparative Examples is mass basis unless otherwise notified. The method for determining physical properties and the method for evaluating characteristics are described below.

[Shape of Surface of Slurry]

The surface of slurry injected onto the flat plane of the container was determined by a laser displacement meter (trade name "LK-G35", manufactured by KEYENCE). For one shot of injection, when the dispersion of high-low height of the injected slurry height T set at the central part (within 50 mm in diameter from the center) was within ±0.2 mm, the evaluation was given to "small dispersion", and when the dispersion thereof was than ±0.2 mm or more, the evaluation was given to "large dispersion". Furthermore, for the case of evaluation of "small dispersion", when the difference in the height T between the central part and the outer peripheral part (5 mm inside from the outermost periphery of the injected slurry) was below 0.3 mm, the evaluation was given to "flat", when the height at the central part was higher than the height at the outer peripheral part by 0.3 to 0.5 mm, the evaluation was given to "somewhat convex", when the height at the central part was higher than the height at the outer peripheral part by 0.5 mm or more, the evaluation was given to "convex", when the height at the central part was lower than the height at the outer peripheral part by 0.3 to 0.5 mm, the evaluation was given to "somewhat concave", and when the height at the central part was lower than the height at the outer peripheral part by 0.5 mm or more, the evaluation was given to "concave".

[Evaluation of Amount of Injected Slurry]

The difference in mass between the filled slurry and the injected slurry was determined by an electronic balance (trade name "GX-12X", manufactured by A & D Co., Ltd.) When the difference was below 5% by mass, the evaluation was given to "good", when the difference was in a range from 5 to 8% by mass, the evaluation was given to "average", and when the difference was exceeding 8% by mass, the evaluation was given to "poor".

[Viscosity of Slurry (dP·s)]

The viscosity of slurry was determined by a rotary viscometer (trade name "VT-04F", manufactured by RION Co., Ltd.).

(Preparation of Slurry)

The slurry was prepared by adding and kneading 100 parts of ceramic powder, 50 parts of water, and 5 parts of methylcellulose.

Example 1

The apparatus for injecting slurry according to the present invention was used to inject thus prepared slurry having a viscosity of 200 dP·s. In detail, the applied apparatus for injecting slurry was the apparatus 71 for injecting slurry with the bottom (provided with the injection holes arranged in grid pattern) as illustrated in FIG. 2, in which, as illustrated in FIG. 6A, the protrusion length d of the convex section 76 was constant at 3 mm, the length f in the injection direction was constant at 13 mm, the distance l between centers of the adjacent convex sections 76 was constant at 8 mm, the shape of the injection hole 75 was circular, the size of the apparatus 71 for injecting slurry was 20 cm, and the diameter 71 of the injection hole (diameter of the injection hole at the central part of the second member was 2.0 mm) successively widened by 7/100 fold from the central part toward the outer peripheral part. The distance W between the flat plane and the protruded end of the convex section of the container was set to 5 mm. The height of the injected slurry was set to 3 mm. Thus the slurry was injected under the condition of estimated shape of the surface of slurry as "flat". The evaluation of the amount of injected slurry was "good", the shape of the surface of slurry was "flat", and the dispersion of the surface of slurry was small.

Examples 2 to 16

The slurry was injected in a similar procedure with that of Example 1 except that the condition given in Table 1 was applied. The evaluation is also given in Table 1.

TABLE 1

| | | Protrusion length (mm) | Distance between centers (mm) | Shape of injection hole | Diameter of injection hole (center → outer periphery) | Length in the injection direction (center → outer periphery) | Size (cm) |
|---|---|---|---|---|---|---|---|
| Examples | 1 | 3 | 8 | Circular shape | 7/100 widened | Constant | 20 |
| | 2 | 3.5 | 8 | Circular shape | 7/100 widened | Constant | 20 |
| | 3 | 4 | 8 | Circular shape | 7/100 widened | Constant | 20 |
| | 4 | 4.5 | 8 | Circular shape | 7/100 widened | Constant | 20 |
| | 5 | 3 | 3 | Circular shape | 7/100 widened | Constant | 20 |
| | 6 | 3 | 5 | Circular shape | 7/100 widened | Constant | 20 |
| | 7 | 3 | 10 | Circular shape | 7/100 widened | Constant | 20 |
| | 8 | 3 | 13 | Circular shape | 7/100 widened | Constant | 20 |
| | 9 | 3 | 8 | Circular shape | 7/100 widened | Constant | 20 |
| | 10 | 3 | 8 | Circular shape | 7/100 widened | Constant | 20 |
| | 11 | 3 | 8 | Circular shape | 7/100 widened | Constant | 20 |
| | 12 | 3 | 8 | Circular shape | 7/100 widened | Constant | 20 |
| | 13 | 3 | 8 | Circular shape | 7/100 widened | Constant | 20 |
| | 14 | 3 | 8 | Circular shape | 7/100 widened | Constant | 20 |
| | 15 | 3 | 8 | Circular shape | 7/100 widened | Constant | 20 |
| | 16 | 3 | 8 | Circular shape | 7/100 widened | Constant | 20 |

| | | Distance (mm) | Height (mm) | Viscosity of slurry (dP · s) | Evaluation of amount of injected slurry | Shape of surface of slurry (expected) | Shape of surface of slurry (observed) |
|---|---|---|---|---|---|---|---|
| Examples | 1 | 5 | 3 | 200 | good | Flat | Small dispersion, flat |

TABLE 1-continued

| | | | | | | |
|---|---|---|---|---|---|---|
| 2 | 5 | 3 | 200 | good | Flat | Small dispersion, flat |
| 3 | 5 | 3 | 200 | good | Flat | Small dispersion, flat |
| 4 | 5 | 3 | 200 | good | Flat | Small dispersion, flat |
| 5 | 5 | 3 | 200 | good | Flat | Small dispersion, flat |
| 6 | 5 | 3 | 200 | good | Flat | Small dispersion, flat |
| 7 | 5 | 3 | 200 | good | Flat | Small dispersion, flat |
| 8 | 5 | 3 | 200 | good | Flat | Small dispersion, flat |
| 9 | 5 | 3 | 10 | average | Flat | Small dispersion, somewhat convex |
| 10 | 5 | 3 | 50 | good | Flat | Small dispersion, flat |
| 11 | 5 | 3 | 100 | good | Flat | Small dispersion, flat |
| 12 | 5 | 3 | 300 | good | Flat | Small dispersion, flat |
| 13 | 5 | 3 | 400 | good | Flat | Small dispersion, flat |
| 14 | 5 | 3 | 500 | average | Flat | Small dispersion, somewhat concave |
| 15 | 5 | 1 | 200 | good | Flat | Small dispersion, flat |
| 16 | 5 | 10 | 200 | good | Flat | Small dispersion, flat |

Examples 17 to 32

The slurry was injected in a similar procedure with that of Example 1 except that the condition given in Table 2 was applied. The evaluation is also given in Table 2.

TABLE 2

| | | Protrusion length (mm) | Distance between centers (mm) | Shape of injection hole | Diameter of injection hole (center → outer periphery) | Length in the injection direction (center → outer periphery) | Size (cm) |
|---|---|---|---|---|---|---|---|
| Examples | 17 | 3 | 8 | Circular shape | 7/100 widened | Constant | 20 |
| | 18 | 3 | 8 | Circular shape | 7/100 widened | Constant | 20 |
| | 19 | 3 | 8 | Circular shape | 7/100 widened | Constant | 10 |
| | 20 | 3 | 8 | Circular shape | 7/100 widened | Constant | 40 |
| | 21 | 3 | 8 | Circular shape | 7/100 widened | Constant | 60 |
| | 22 | 3 | 8 | Triangular shape | 7/100 widened | Constant | 20 |
| | 23 | 3 | 8 | Quarangular shape | 7/100 widened | Constant | 20 |
| | 24 | 3 | 8 | Circular shape | 5/100 widened | Constant | 20 |
| | 25 | 3 | 8 | Circular shape | 10/100 widened | Constant | 20 |
| | 26 | 3 | 8 | Circular shape | 4/100 Widened | Constant | 20 |
| | 27 | 3 | 8 | Circular shape | 20/100 Widened | Constant | 20 |
| | 28 | 3 | 8 | Circular shape | 7/100 narrowed | Constant | 20 |
| | 29 | 3 | 8 | Circular shape | Constant | 10/100 | 20 |
| | 30 | 3 | 8 | Circular shape | Constant | 4/100 | 20 |
| | 31 | 3 | 8 | Circular shape | Constant | 20/100 | 20 |
| | 32 | 3 | 8 | Circular shape | Constant | 110/100 | 20 |

| | | Distance (mm) | Height (mm) | Viscosity of slurry (dP · s) | Evaluation of amount of injected slurry | Shape of surface of slurry (expected) | Shape of surface of slurry (observed) |
|---|---|---|---|---|---|---|---|
| Examples | 17 | 3 | 3 | 200 | good | Flat | Small dispersion, flat |
| | 18 | 10 | 3 | 200 | good | Flat | Small dispersion, fiat |
| | 19 | 5 | 3 | 200 | good | Flat | Small dispersion, flat |
| | 20 | 5 | 3 | 200 | good | Flat | Small dispersion, flat |
| | 21 | 5 | 3 | 200 | good | Flat | Small dispersion, flat |

TABLE 2-continued

| | | | | | | |
|---|---|---|---|---|---|---|
| 22 | 3 | 3 | 200 | good | Flat | Small dispersion, flat |
| 23 | 3 | 3 | 200 | good | Flat | Small dispersion, flat |
| 24 | 3 | 3 | 200 | good | Flat | Small dispersion, flat |
| 25 | 3 | 3 | 200 | good | Flat | Small dispersion, flat |
| 26 | 3 | 3 | 200 | good | Convex | Small dispersion, convex |
| 27 | 3 | 3 | 200 | good | Concave | Small dispersion, concave |
| 28 | 3 | 3 | 200 | good | Convex | Small dispersion, convex |
| 29 | 3 | 3 | 200 | good | Flat | Small dispersion, flat |
| 30 | 3 | 3 | 200 | good | Convex | Small dispersion, convex |
| 31 | 3 | 3 | 200 | good | Concave | Small dispersion, concave |
| 32 | 3 | 3 | 200 | good | Convex | Small dispersion, convex |

Comparative Examples 1 to 12

The slurry was injected in a similar procedure with that of Example 1 except that the condition given in Table 3 was applied. The evaluation is also given in Table 3.

TABLE 3

| | | Protrusion length (mm) | Distance between centers (mm) | Shape of injection hole | Diameter of injection hole (center → outer periphery) | Length in the injection direction (center → outer periphery) | Size (cm) |
|---|---|---|---|---|---|---|---|
| Comparative Examples | 1 | 0 | 8 | Circular shape | 7/100 widened | Constant | 20 |
| | 2 | 2 | 8 | Circular shape | 7/100 widened | Constant | 20 |
| | 3 | 6 | 8 | Circular shape | 7/100 widened | Constant | 20 |
| | 4 | 10 | 8 | Circular shape | 7/100 widened | Constant | 20 |
| | 5 | 3 | 8 | Circular shape | 7/100 widened | Constant | 20 |
| | 6 | 3 | 8 | Circular shape | 7/100 widened | Constant | 20 |
| | 7 | 3 | 2 | Circular shape | 7/100 widened | Constant | 20 |
| | 8 | 3 | 14 | Circular shape | 7/100 widened | Constant | 20 |
| | 9 | 3 | 8 | Circular shape | 7/100 widened | Constant | 20 |
| | 10 | 3 | 8 | Circular shape | 7/100 widened | Constant | 20 |
| | 11 | 3 | 8 | Circular shape | 7/100 widened | Constant | 20 |
| | 12 | 3 | 8 | Circular shape | 7/100 widened | Constant | 20 |

| | | Distance (mm) | Height (mm) | Viscosity of slurry (dP · s) | Evaluation of amount of injected slurry | Shape of surface of slurry (expected) | Shape of surface of slurry (observed) |
|---|---|---|---|---|---|---|---|
| Comparative Examples | 1 | 5 | 3 | 200 | poor | Flat | Small dispersion, flat |
| | 2 | 5 | 3 | 200 | poor | Flat | Small dispersion, flat |
| | 3 | 5 | 3 | 200 | poor | Flat | Small dispersion, flat |
| | 4 | 5 | 3 | 200 | poor | Flat | Small dispersion, flat |
| | 5 | 5 | 3 | 5 | average | Flat | Small dispersion, convex |
| | 6 | 5 | 3 | 1005 | average | Flat | Small dispersion, concave |
| | 7 | 5 | 3 | 200 | poor | Flat | Large dispersion |
| | 8 | 5 | 3 | 200 | poor | Flat | Large dispersion |
| | 9 | 5 | 0.5 | 200 | poor | Flat | Small dispersion, flat |
| | 10 | 5 | 11 | 200 | poor | Flat | Large dispersion |
| | 11 | 2 | 3 | 200 | poor | Flat | Large dispersion |
| | 12 | 11 | 3 | 200 | poor | Flat | Large dispersion |

When the slurry was injected using the method for injecting slurry according to the present invention, the evaluation of the amount of injected slurry was "good" or "average" (Examples 9 and 14) independent of the size of the apparatus for injecting slurry, the shape of injection hole, the gradient in diameter of the injection holes, and the injection length of the convex section, and the height difference of slurry at central part was "small dispersion", thus the shape of the surface of slurry could be brought to the desired shape or near the desired shape (Examples 9 and 14). To the contrary, when the slurry was injected not using the method for injecting slurry of the present invention, specifically when the protrusion length of the convex section was not in the desired range (Comparative Examples 1 to 4), and when the height of injected slurry was short (Comparative Example 7), the evaluation of the amount of injected slurry was "poor". When the distance between centers of adjacent convex sections was not in the desired range (Comparative Examples 5 and 6), when the height of injected slurry was high (Comparative Example 8), or when the distance between the flat plane of the container and the protruded end of the convex section of the container was outside the desired range (Comparative Examples 9 and 10), the evaluation of the amount of injected slurry was "poor", and further the difference in height of the slurry at the central part was "large dispersion", thus failing to attain the desired shape of surface of the slurry. When slurry having extremely high or extremely low viscosity was injected (Comparative Examples 5 and 6), the evaluation of the amount of injected slurry was "average", and the shape of the surface of injected slurry was not able to attain the desired shape, though the difference in height of the slurry at the central part was "small dispersion".

Comparative Example 11

Figure 3:
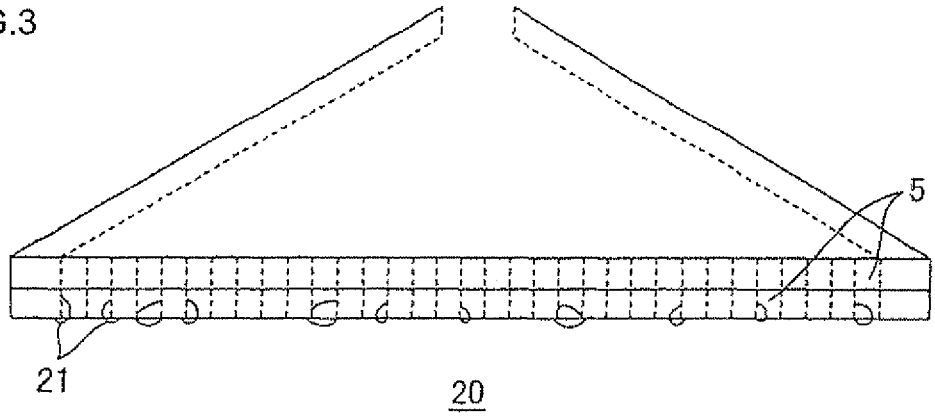
FIG. 3 is a schematic drawing illustrating an example of slurry-injected state using an apparatus for injecting slurry of the related art.

The slurry was injected using the conventional apparatus for injecting slurry, or the apparatus for injecting slurry having no convex section. FIG. 3 is a schematic drawing of an example of injecting slurry using the conventional apparatus for injecting slurry. As seen in FIG. 3, the use of conventional apparatus for injecting slurry may generate remained slurry in the injection hole.

The results of Example 1 and Comparative Example 11 show that the injection of slurry using the apparatus for injecting slurry according to the present invention can suppress the generation of remained slurry in the injection hole.

The apparatus for injecting slurry according to the present invention and the method for injecting slurry using the same can be economically and efficiently used to provide plugging of DPF and the like. Accordingly, the apparatus and the method of the present invention are suitably applicable to the manufacture of filter used in environmental measures such as pollution prevention, in product-collection from high temperature gas, and the like.

What is claimed is:

1. An apparatus for injecting slurry made of at least a ceramic powder and a disperser for slurry, the slurry having a viscosity in a range from 10 to 1000 dPa·s, comprising:

a first member having a cavity therein; and a second member having a plurality of convex sections, each of said convex sections having an injection hole formed therein communicating with said cavity, wherein a protrusion length of each of said convex sections is in a range from 3 to 5 mm, the protrusion length of each of said convex sections being a partial length of a convex section from a main body of the second member to an end of the convex section, said convex sections positioned with respect to said cavity of the first member such that extension lines extended along the length of each of said convex sections cross into said cavity of the first member, a distance between centers of adjacent said convex sections is in a range from 3 to 13 mm, and the first member has an introduction opening positioned so as to face said convex sections through the cavity.

2. The apparatus for injecting slurry according to claim 1, wherein a diameter of said injection holes formed inside of said convex sections at an outer peripheral part of said second member and a diameter of said injection holes formed inside of said convex sections at a central part of said second member are not the same with each other.

3. The apparatus for injecting slurry according to claim 1, wherein a diameter of said injection holes formed inside of said convex sections at an outer peripheral part of said second member is larger than a diameter of said injection holes formed inside of said convex section at a central part of said second member.

4. The apparatus for injecting slurry according to claim 1, wherein said injection holes have respective diameters that successively widen or narrow from a central part toward an outer peripheral part of said second member.

5. The apparatus for injecting slurry according to claim 1, wherein a length of said second member in an injection direction at an outer peripheral part thereof and a length of said second member in the injection direction at a central part thereof are not the same with each other.

6. The apparatus for injecting slurry according to claim 1, wherein a length of said second member in an injection direction at an outer peripheral part thereof is shorter than a length of said second member in the injection direction at a central part thereof.

7. The apparatus for injecting slurry according to claim 1, wherein a length of said second member in an injection direction progressively elongates or shortens from a central part toward an outer peripheral part of said second member.

8. The apparatus for injecting slurry according to claim 1, wherein a diameter of said injection holes formed inside of said convex sections at an outer peripheral part of said second member is smaller than a diameter of said injection holes formed inside of said convex section at a central part of said second member.

9. A method for injecting slurry, comprising:

a filling step which comprises filling a slurry in said cavity of the apparatus for injecting slurry according to claim 1; and an injection step which comprises above a flat plane in a container, causing a protruded end of each of said convex sections to face said flat plane with said flat plane and said protruded end of each of said convex sections spaced apart from each other by a distance of 3 to 10 mm, and injecting said slurry onto said flat plane.

10. The method for injecting slurry according to claim 9, wherein said injection step is the step of holding the slurry injected onto said flat plane at a height ranging from 1 to 10 mm thereon.

11. The method for injecting slurry according to claim 9, wherein a viscosity of said slurry is in a range from 50 to 500 dP·s.

* * * * *